US008266746B2

(12) United States Patent
Oh et al.

(10) Patent No.: US 8,266,746 B2
(45) Date of Patent: Sep. 18, 2012

(54) SELF-ADJUSTING MATTRESS WITH BALANCING BARS AND AN INTEGRATED MOVEMENT MECHANISM

(75) Inventors: Suk Kan Oh, Xiamen (CN); Youn Jae Lee, Pleasanton, CA (US)

(73) Assignee: Zinus, Inc., Hayward, CA (US)

( * ) Notice: Subject to any disclaimer, the term of this patent is extended or adjusted under 35 U.S.C. 154(b) by 123 days.

(21) Appl. No.: 12/798,638

(22) Filed: Apr. 7, 2010

(65) Prior Publication Data

US 2011/0247144 A1 Oct. 13, 2011

(51) Int. Cl.
*A47C 17/00* (2006.01)

(52) U.S. Cl. ..... 5/722; 5/618; 5/617; 5/737

(58) Field of Classification Search ..... 5/722, 716, 5/713, 617, 618
See application file for complete search history.

(56) References Cited

U.S. PATENT DOCUMENTS

| | | | | |
|---|---|---|---|---|
| 2,649,595 | A | 8/1953 | Lewin | 5/345 |
| 4,893,365 | A | 1/1990 | Justice | 5/68 |
| 5,737,783 | A | 4/1998 | Antinori | 5/411 |
| 5,791,001 | A | 8/1998 | Wang | 5/716 |
| 5,978,992 | A | 11/1999 | Antinori | 5/658 |
| 6,061,852 | A | 5/2000 | Bathrick et al. | 5/618 |
| 6,408,470 | B1 | 6/2002 | Powers | 5/735 |
| 6,754,922 | B2 | 6/2004 | Dewert | 5/617 |
| 6,889,396 | B2 | 5/2005 | Weinman | 5/411 |
| 7,107,642 | B2 | 9/2006 | Wong et al. | 5/713 |
| 7,293,309 | B1 * | 11/2007 | Shih | 5/618 |
| 7,395,568 | B2 | 7/2008 | Damewood | 5/722 |
| 2002/0152552 | A1 * | 10/2002 | Dewert | 5/618 |
| 2005/0257319 | A1 | 11/2005 | Ikeda et al. | 5/618 |
| 2008/0028535 | A1 | 2/2008 | Rodrigues | 5/722 |
| 2009/0211028 | A1 | 8/2009 | Richmond et al. | 5/618 |

FOREIGN PATENT DOCUMENTS

| | | |
|---|---|---|
| DE | 102006030674 | 1/2008 |
| EP | 1192883 | 4/2002 |
| EP | 1529618 | 5/2005 |
| WO | WO 2008/006133 | 1/2008 |

OTHER PUBLICATIONS

Extended European search report (EESR) in related European application 10187978.1 dated Jun. 14, 2011 (10 pages).

* cited by examiner

*Primary Examiner* — Robert G Santos
*Assistant Examiner* — Brittany Wilson
(74) *Attorney, Agent, or Firm* — Imperium Patent Works; Darien K. Wallace

(57) ABSTRACT

A self-adjusting mattress includes a support member, top and bottom foam layers, a movement mechanism and balancing bars. The support member includes a frame of longitudinal and cross bars and mesh panels between the bars. The support member has a middle section that is pivotally connected to upper and lower sections. The upper, middle and lower sections are coplanar in the flat configuration of the mattress. The movement mechanism includes multiple electric motors that move the mattress into an inclined configuration by rotating the upper and lower sections relative to the middle section. The bottom foam layer is molded around the support member. The molded foam flows above, below and through the holes in the mesh panels. The top foam layer is then glued or molded to the top of the bottom foam layer. The balancing bars extend less than half way under the upper section of the support member.

18 Claims, 12 Drawing Sheets

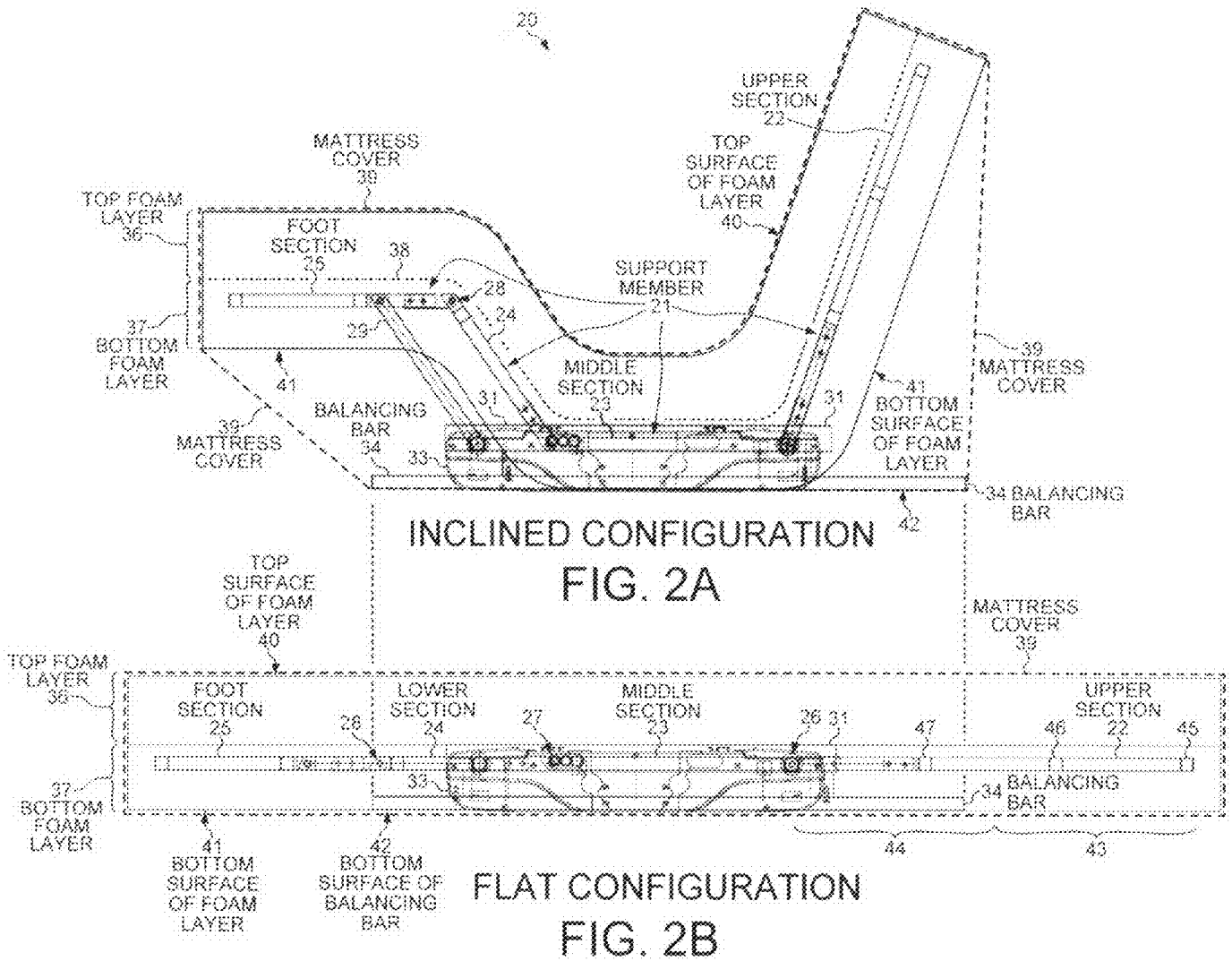
20
UPPER SECTION 22
TOP SURFACE OF FOAM LAYER 40
SUPPORT MEMBER 21
MIDDLE SECTION 23
MATTRESS COVER 39
FOOT SECTION 25
BALANCING BAR 34
BOTTOM SURFACE OF FOAM LAYER 41
TOP FOAM LAYER 36
BOTTOM FOAM LAYER 37
INCLINED CONFIGURATION
FIG. 2A
UPPER SECTION 22
MIDDLE SECTION 23
LOWER SECTION 24
FOOT SECTION 26
BALANCING BAR 34
BOTTOM SURFACE OF BALANCING BAR 42
BOTTOM SURFACE OF FOAM LAYER 41
TOP FOAM LAYER 36
BOTTOM FOAM LAYER 37
FLAT CONFIGURATION
FIG. 2B

SELF-ADJUSTING MATTRESS WITH BALANCING BARS AND AN INTEGRATED MOVEMENT MECHANISM

TECHNICAL FIELD

The present invention relates to adjustable beds, and in particular to a movement mechanism that is contained inside a self-adjusting foam mattress.

BACKGROUND INFORMATION

Adjustable beds have long been available to average consumers. Nevertheless, the average American household does not have an adjustable bed. Most people associate adjustable beds with the sick and elderly. One is much more likely to find an adjustable bed in a hospital or convalescent center than in the apartment of a young adult or in the home of a young family. But young and middle aged consumers can also benefit from the convenience of being able to watch television or read more comfortably in bed.

Unfortunately, there are multiple disadvantages to adjustable beds that most consumers find outweigh the added comfort and convenience that adjustable beds provide. One disadvantage is that a conventional adjustable bed cannot be used in combination with a box spring or platform bed. The mattress of a conventional adjustable bed rests on an adjustable support member instead of on a box spring. The adjustable support member in connected to a movement mechanism and to a frame with wheels. The wheeled frame, support member and movement mechanism do not easily fit on top of a box spring or platform bed. In order to use a conventional adjustable bed, the consumer must forego the aesthetic qualities of a platform bed or a box spring framed by a headboard and footboard. Consequently, a conventional adjustable bed imparts the appearance of a hospital room as opposed to a bedroom.

FIG. 1 (prior art) shows a conventional adjustable bed 10 with an adjustable support member 11, a movement mechanism 12 and a frame with wheels 13. Movement mechanism 12 is positioned by a motor that is hidden below adjustable support member 11 in the perspective of FIG. 1. A mattress 14 rests on adjustable support member 11. Many young and middle aged consumers are deterred from purchasing an adjustable bed such as the one shown in FIG. 1 because they feel it does not fit their life style and belongs more appropriately in a hospital. An adjustable bed is sought that can be used with a stylish platform bed or with a headboard and footboard in order for manufacturers of adjustable beds to reach a larger customer base.

Another disadvantage of conventional adjustable beds is that the mattress does not bend sufficiently in an inclined sitting position to conform to the underlying adjustable support member. Adjustable bed 10 in FIG. 1 is in an inclined sitting position. In FIG. 1, mattress 14 in the section below an occupant's thighs has not bent sufficiently to conform to adjustable support member 11 and has created a gap 15. Because mattress 14 does not adequately conform to the shape of adjustable support member 11, the sleeping surface of mattress 14 does not achieve the configuration formed by adjustable support member 11, and the occupant of adjustable bed 10 does not benefit from the desired resting position. The various sitting and reclining positions achieved by adjustable bed 10 depend on which mattress is used.

Yet another disadvantage of conventional adjustable beds is that the mattress tends to shift or slide from side to side and from end to end when the occupant enters and exits the bed. In an attempt to solve this problem, some conventional adjustable beds employ a foot rail. For example, adjustable bed 10 has a foot rail 16 in the shape of a bent metal tube. Foot rail 16 does not, however, prevent mattress 14 from protruding beyond the top of adjustable support member 11 when adjustable bed 10 is placed in the elevated sitting position, as shown in FIG. 1. In addition, foot rail 16 is a metal bar near the sleeping surface of the foot of mattress 14. An occupant's foot could hit the metal bar if the occupant's leg is energetically lowered over the end of mattress 14.

And foot rail 16 does not prevent mattress 14 from shifting from side to side. FIG. 1 shows that the foot of mattress 14 has shifted to the left 17, and the head of the mattress has shifted to the right 18 from the perspective of a reclining occupant. Mattress 14 will be increasingly skewed after each exit and entry into adjustable bed 10. To solve this problem, some conventional adjustable beds employ mattress retention brackets such as those described in U.S. Pat. No. 5,737,783. It is likely, however, that the occupant's body will come in contact with the metal retention brackets that are placed near the edge of the sleeping surface of the mattress. Moreover, it is difficult to insert bedding under the mattress when one must slip the bedding between the mattress and the mattress retention brackets or foot rail.

An adjustable bed is sought that can be used with a platform bed and whose mattress conforms to the desired configurations and is prevented from shifting without using retention brackets and foot rails.

SUMMARY

A self-adjusting foam mattress includes a support member, a top foam layer, a bottom foam layer, a movement mechanism, balancing bars and a mattress cover. The support member includes a support frame of longitudinal and cross bars as well as metal mesh panels between the bars. The support member has a middle section that is pivotally connected to both an upper section and to a lower section. The support member also has a foot section that remains parallel to the middle section when the lower section is inclined. The upper, middle, lower and foot sections are coplanar when the adjustable mattress is in a flat configuration. The movement mechanism includes two electric motors that move the mattress into an inclined configuration by rotating the upper section and the lower section relative to the middle section. The bottom foam layer is molded around the support member. The molded foam of the bottom foam layer flows above, below and through the holes in the metal mesh panels. By molding harder, high-density foam through the mesh of the panels, the bottom foam layer is made more durable and less likely to tear and separate from the support member as the adjustable mattress changes configuration may times over its lifetime.

The top foam layer is then glued or molded to the top of the bottom foam layer. The balancing bars are coplanar with the bottom surface of the bottom foam layer beneath the middle section. The balancing bars extend less than half way under the upper section when the adjustable mattress is in a flat configuration so as to give the appearance that a regular mattress is levitating when the upper section is slightly inclined. No part of the support member, foam layers, movement mechanism or balancing bars is disposed directly below the upper half of the upper section when the upper section is inclined five degrees from the plane of the bottom surface of the balancing bars. To prevent the adjustable mattress from tipping when the mattress is slightly inclined, the balancing bars extend at least one third of the way under the upper section measured when the mattress is in a flat configuration.

The support member, foam layers, movement mechanism and balancing bars are encased in a mattress cover that is made of stretchable material. When the adjustable mattress is in an inclined configuration, the mattress cover stretches between the balancing bars and the bottom foam layer beneath the upper section of the support member.

The various sections of the support member are pivotally connected to one another at hinges by bolts that pass through polyvinyl chloride (PVC) washers. The PVC washers are used instead of conventional metal washers in order to prevent squeaking and to reduce friction at the joints about which the various sections pivot.

In another embodiment, the self-adjusting mattress includes upper, middle and lower sections and balancing bars. The upper section has an upper support member disposed between a top foam layer and a bottom foam layer. The middle section has a middle support member disposed between the top and bottom foam layers. And the lower section has a lower support member disposed between the top and bottom foam layers. The middle support member is pivotally connected to both the upper support member and to the lower support member. The bottom surface of the balancing bars is coplanar with the bottom surface of the bottom foam layer at the middle section. The balancing bars are parallel to the upper support member when the upper section is in a flat configuration. The balancing bars extend from under the middle section less than half way under the upper section when the upper section is in the flat configuration. A mattress cover made of stretchable material encases the upper section, the middle section, the lower section and the balancing bars.

A method of making the novel self-adjusting foam mattress involves attaching foam layers to a support member and connecting balancing bars to the support member. The support member includes an upper section, a middle section, and a lower section. The upper section of the support member includes a mesh panel supported by longitudinal and cross bars of the upper section.

A bottom foam layer is attached to the support member by molding the bottom foam layer above, below and through the mesh panel. Then a top foam layer is attached to the bottom foam layer. The top foam layer may be either glued to the bottom foam layer or molded over the bottom foam layer. After the top and bottom foam layers are attached to the support member, the support member is entirely disposed between the top surface of the top foam layer and the bottom surface of the bottom foam layer.

Balancing bars are then connected to the support member such that the bottom surface of the balancing bars is coplanar with the bottom surface of the bottom foam layer beneath the middle section. The balancing bars extend less than half way under the upper section of the support member when the upper section is parallel to the bottom surface of the balancing bar. The top foam layer, the support member, the bottom foam layer and the balancing bars are then encased in a mattress cover.

An adjustable mattress that includes top and bottom foam layers and a support frame of bars also includes a means for attaching the bottom foam layer to the support frame of bars without using glue. The means has holes and is attached to the support frame of bars. The foam of the bottom foam layer is disposed in the holes, and the bottom foam layer is molded above, below and through the means. The support frame of bars is disposed entirely between the top surface of the top foam layer and the bottom surface of the bottom foam layer. The support frame of bars includes an upper section, a middle section and a lower section. The middle section is pivotally connected both to the upper section and to the lower section. The upper, middle and lower sections are coplanar when the adjustable mattress is in a flat configuration.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

FIG. 2A is a schematic diagram of a novel self-adjusting foam mattress with balancing bars and an integrated movement mechanism in an inclined configuration.

FIG. 2B is a schematic diagram of the adjustable mattress of FIG. 2A in a flat configuration.

DETAILED DESCRIPTION

Figure 1:
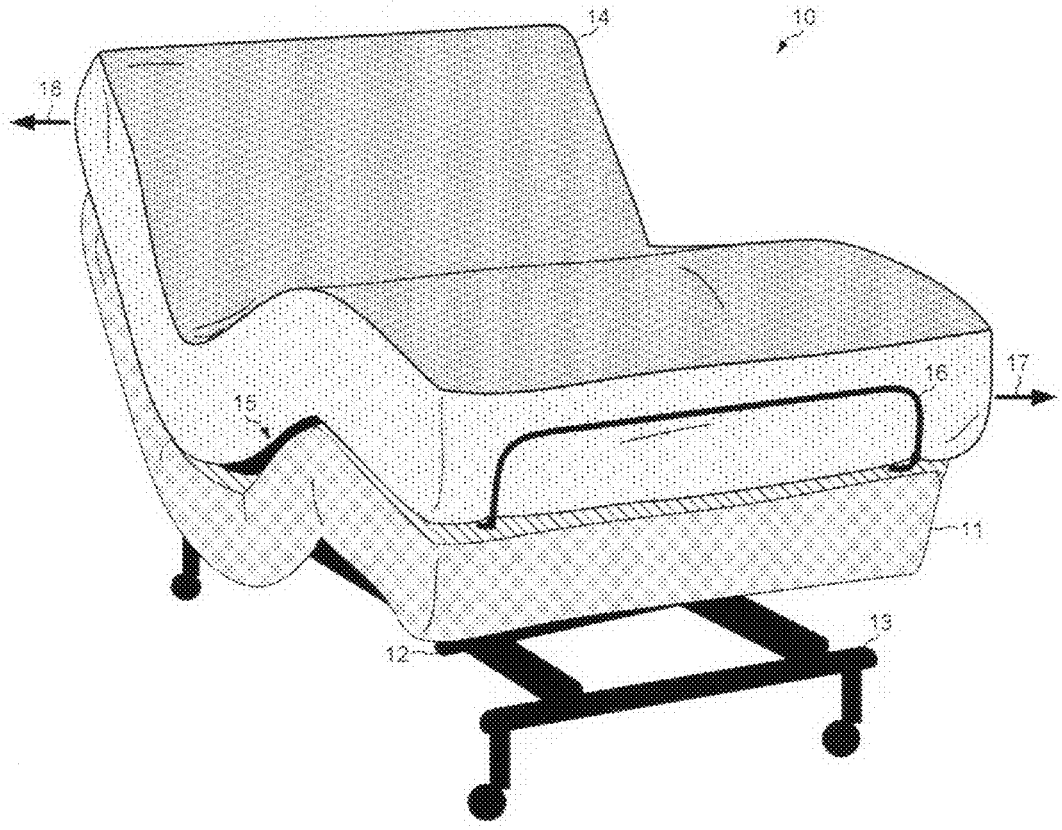
FIG. 1 (PRIOR ART)
FIG. 1 (prior art) is a perspective view of a conventional adjustable bed whose mattress is retained by a foot rail and conforms only partly to the configuration of the adjustable support member upon which the mattress rests.

FIGS. 2A and 2B are schematic diagrams of a self-adjusting foam mattress 20 with balancing bars and an integrated movement mechanism. Self-adjusting mattress 20 has a support member 21 that is integrated into the mattress. Mattress 20 can adjust itself from a flat configuration into one of multiple inclined configurations without a separate adjustable support member used by conventional adjustable beds. Mattress 20 can be placed directly on a conventional box spring or platform bed just as a typical foam mattress. Thus, the user of self-adjusting mattress 20 can retain her existing platform bed or box spring and headboard and simply swap out the old mattress. The user of mattress 20 need not forego the aesthetic qualities of the platform bed or headboard and footboard.

FIG. 2A is a side view of adjustable mattress 20 in one predetermined inclined configuration that would be comfortable for reading or watching television. Support member 21 includes an upper section 22, a middle section 23, a lower section 24 and a foot section 25. Middle section 23 is pivotally connected to both upper section 22 and to lower section 24. Lower section 24 is pivotally connected to foot section 25. Upper section 22 and middle section 23 pivot about axis 26; middle section 23 and lower section 24 pivot about axis 27; and lower section 24 and foot section 25 pivot about axis 28. Two additional elevation arms 29-30 are pivotally connected both to foot section 25 and to central support beams 31-32. Elevation arms 29-30 cause foot section 25 to remain parallel to middle section 23 as lower section 24 inclines. Central support beams 31-32 are in turn connected to middle section 23 of support member 21.

A movement mechanism 33 is encased in a central elongated unit that includes gears, cables and two electric motors. One electric motor causes upper section 22 to incline relative to central support beams 31-32. The other electric motor causes elevation arms 29-30 to incline relative to central support beams 31-32. Two balancing bars 34-35 are connected to central support beams 31-32 on either side of movement mechanism 33. Adjustable mattress 20 also includes a top foam layer 36 and a bottom foam layer 37. Top foam layer 36 is glued, laminated or molded over bottom foam layer 37. The boundary between top foam layer 36 and bottom foam layer 37 is indicated by dashed line 38 in FIG. 2A. A mattress cover 39 encases top foam layer 36, support member 21, bottom foam layer 37, movement mechanism 33 and balancing bars 34-35. Mattress cover 39 is made of a stretchable material, such as Spandex® or Lycra®, that can stretch over the bottom of adjustable mattress 20 from the upper edge of balancing bars 34-35 to the upper edge of upper section 22 when upper section 22 is inclined.

Top foam layer 36 has a top surface 40 that forms the sleeping surface of adjustable mattress 20 just below mattress cover 39. Bottom foam layer 37 has a bottom surface 41 that rests on mattress cover 39 on the supporting surface of a box spring or platform bed when adjustable mattress 20 is in a flat configuration. In the inclined configuration shown in FIG. 2A, only the portion of bottom surface 41 that is beneath middle section 23 rests on the box spring or platform bed; the remaining portions of bottom surface 41 are elevated. Support member 21 is disposed completely between top surface 40 of top foam layer 36 and bottom surface 41 of bottom foam layer 37. In the embodiment of FIG. 2A, bottom foam layer 37 is molded around support member 21 and completely encases support member 21. Top foam layer 36 is then glued, laminated or molded on top of bottom foam layer 37.

FIG. 2B is a side view of adjustable mattress 20 in a flat configuration that is appropriate for sleeping. In the flat configuration, upper section 22, middle section 23, lower section 24 and foot section 25 are coplanar. Movement mechanism 33 includes two electric motors that are disposed completely between top surface 40 of top foam layer 36 and bottom surface 41 of bottom foam layer 37. FIG. 2B shows the bottom surface 42 of balancing bar 34. When adjustable mattress 20 is in the flat configuration, bottom surface 42 of balancing bar 34 is coplanar with bottom surface 41 of bottom foam layer 37. Balancing bar 34 extends less than half way under upper section 22 when adjustable mattress 20 is in the flat configuration. FIG. 2B shows that upper section 22 has an upper half 43 and a lower half 44. In the embodiment of FIG. 2, no part of adjustable mattress 20 is disposed directly below upper half 43 of upper section 22 when upper section 22 is minimally includes, for example, by five degrees, from the plane of bottom surface 42 of balancing bar 34.

Figure 3:
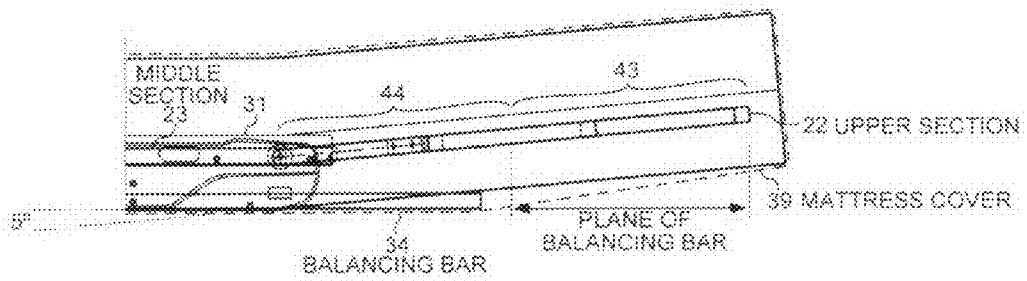
FIG. 3 shows the upper part of the adjustable mattress of FIG. 2A when an upper section of the mattress is inclined by just five degrees.

FIG. 3 shows the upper part of adjustable mattress 20 when upper section 22 is inclined five degrees from the plane of bottom surface 42 of balancing bar 34. No part of adjustable mattress 20 is disposed in the plane of the bottom surface of the balancing bar directly below upper half 43 of upper section 22 when upper section 22 is inclined five degrees. Thus, when adjustable mattress 20 inclines, there is an appearance that a regular mattress is elevating because balancing bar 34 is relatively short and does not extend all the way to the head edge or foot edge of mattress 20. In order to prevent upper section 22 from tipping back when the occupant of mattress 20 slides toward the head of the mattress, balancing bar 34 should extend at least one third of the way under upper section 22 measured when adjustable mattress 20 is in a flat configuration.

Figure 4:
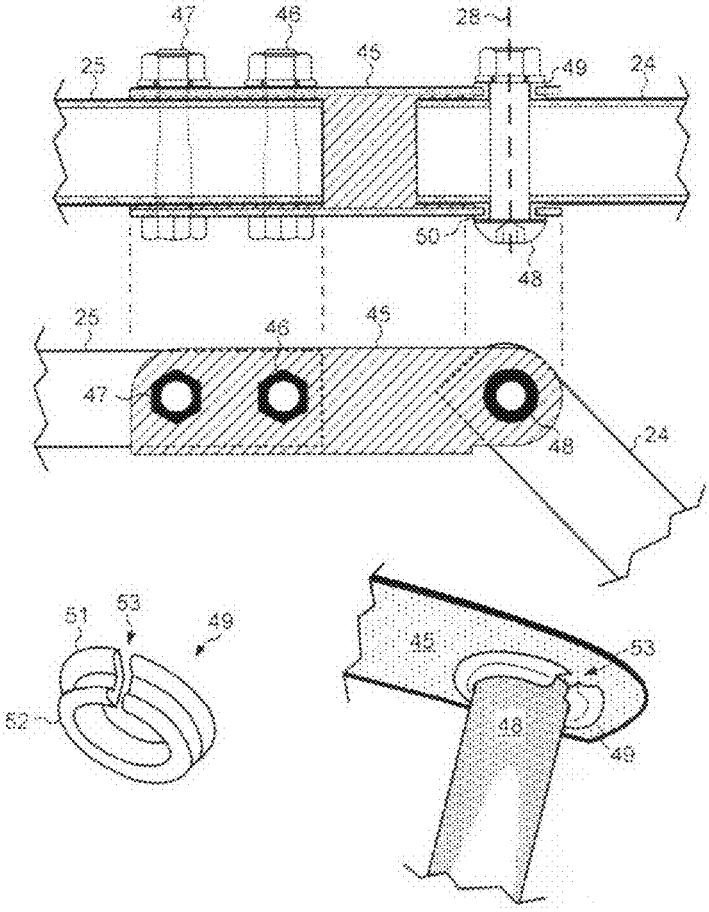
FIG. 4 shows schematic diagrams of various views of the means by which the various sections of the support member of the mattress of FIG. 2A are pivotally connected together.

FIG. 4 illustrates the means by which the various sections of support member 21 are pivotally connected together about axes 26-28. FIG. 4 corresponds to the orientation of the connection between lower section 24 and foot section 25, but applies equally to the connection between lower section 24 and middle section 23 and to the connection between middle section 23 and upper section 22. The longitudinal bars of lower section 24 and foot section 25 do not touch, but rather are connected by a short link bar 45. The longitudinal and cross bars of support member 21 are metal tubes with a square cross section. Link bar 45 is an angle iron of bent metal on three sides of a square tube that is slightly larger than the square tubes of the longitudinal bars. The top of link bar 45 is open, and link bar 45 fits around, three sides of the ends of the longitudinal bars of lower section 24 and foot section 25. Using tubes with a square as opposed to round cross section provides added stability and prevents support member 21 from twisting while mattress 20 is being adjusted. Link bar 45 is attached to the longitudinal bar of foot section 25 by two bolts 46-47. Link bar 45 is pivotally attached to the longitudinal bar of lower section 24 by a bolt 48. Axis 28 about which lower section 24 and foot section 25 pivot goes through the center of the cylinder of bolt 48.

In order to prevent squeaking and to reduce friction at the joint about axis 28, two polyvinyl chloride (PVC) washers 49-50 are used instead of conventional metal washers. Bolt 48 rotates within PVC washers 49-50 instead of touching the metal of link bar 45, as would be the case if conventional metal disk washers were used. FIG. 4 shows that PVC washer 49 has both an outer flange 51 and an inner flange 52. Outer flange 51 cushions the junction between the head of bolt 48 and the side of link bar 45. Inner flange 52 cushions the junction between the side of link bar 45 and the side of the longitudinal bar of lower section 24. The only metal-on-metal contact is between bolt 48 and the walls of the holes in the longitudinal bar of lower section 24. PVC washer has a gap 53 that permits its circumference to be reduced so that flange 52 may be snapped through a hole in the side of link bar 45.

Figure 5:
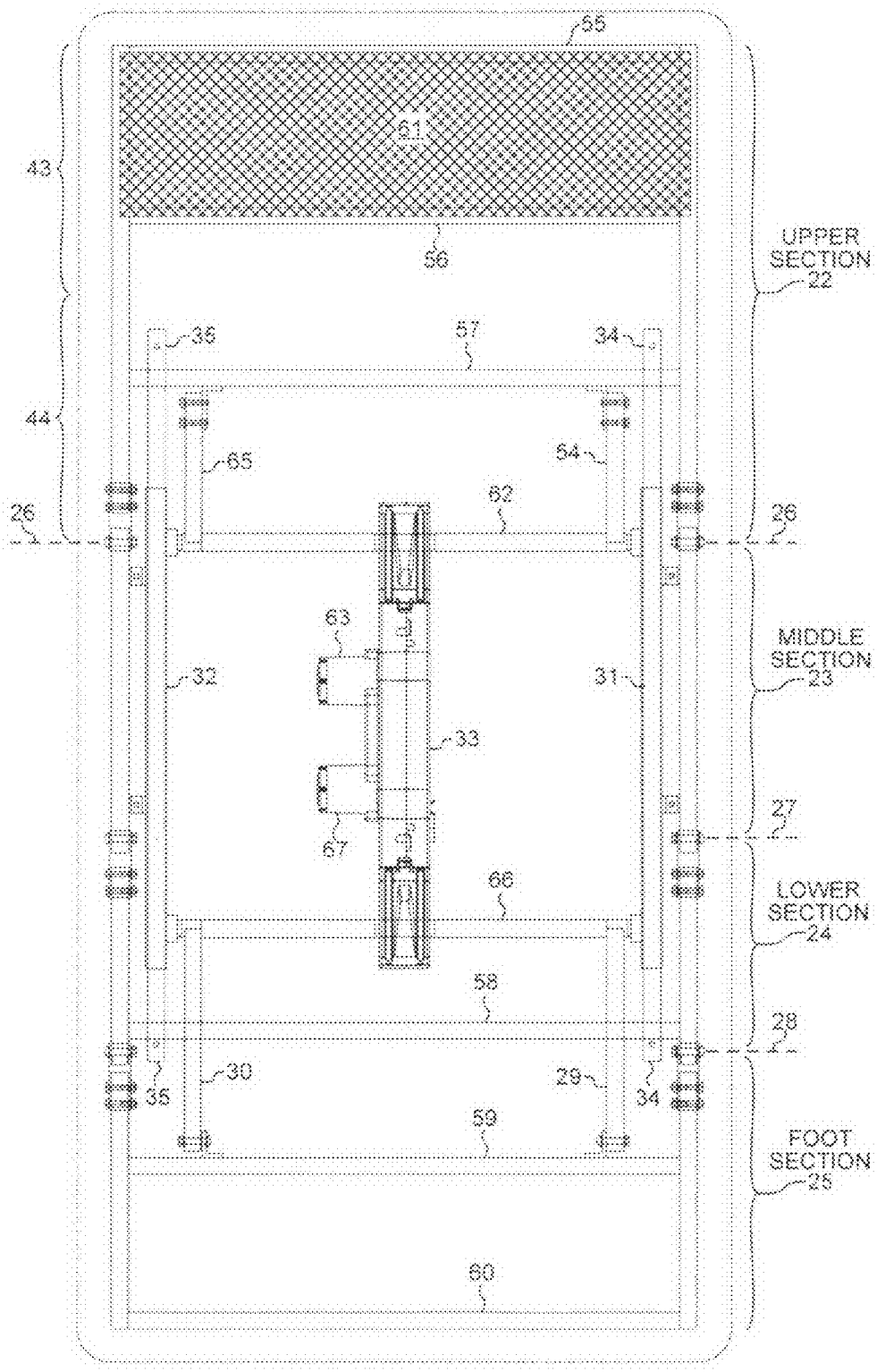
FIG. 5 is a top-down schematic diagram of the support member of the adjustable mattress of FIG. 2A in the flat configuration.

FIG. 5 is a top-down schematic diagram of self-adjusting foam mattress 20 in the flat configuration. Support member 21 includes a support frame of bars with not only the longitudinal bars apparent in FIG. 2, but also six cross bars 55-60. In addition, support member 21 includes panels of metal mesh between the longitudinal bars. The metal mesh is either welded or screwed to the longitudinal and cross bars. Each of upper section 22, middle section 23, lower section 24 and foot section 25 has two panels. In FIG. 5, only one panel 61 of upper section 22 is shown. In an alternative embodiment, the panels are made of stiff plastic sheets. In the top-down view of FIG. 5, central support beams 31-32 are above balancing bars 34-35, respectively. Central support beam 31 is attached to one longitudinal bar of middle section 23, while central support beam 32 is attached to the other longitudinal bar of middle section 23.

FIG. 5 shows axis 26 about which upper section 22 pivots about middle section 23. Axis 26 is collinear with the axis of a first shaft 62 that is rotated by a first electric motor 63 of movement mechanism 33. As first shaft 62 rotates, elevation arms 64-65 that are attached to first shaft 62 incline upper section 22. A second shaft 66 is rotated by a second electric motor 67 of movement mechanism 33. As second shaft 66 rotates, elevation arms 29-30 that are attached to second shaft 66 incline lower section 24. Because foot section 25 is pivotally connected to both lower section 24 as well as to elevation arms 29-30, foot section 25 remains horizontal and parallel to middle section 23 as lower section 24 inclines.

The metal mesh panels and cross bars of support member 21 are encased in the molded foam of bottom foam layer 37. The holes in the mesh panels provide a benefit over using solid planar panels because molded foam can better attach to the holes in the mesh. Mesh panel 61 that is attached to upper section 22 of the support frame of longitudinal and cross bars provides a means for attaching bottom foam layer 37 to the support frame of bars without using glue. Molded foam flows above, below and through the holes of the metal mesh panels. As the various sections of support member 21 incline and elevate, the molded foam conforms to the configuration of support member 21. The foam of bottom foam layer 37 is molded in four separate pieces, and the longitudinal bars, movement mechanism 33, second shaft 66 and cross bar 58 are not encased in foam.

In another embodiment, sheets of plastic, are used for the panels. Molded foam can adhere directly to the planar surface of some types of plastic without using glue. The plastic panels are glued or screwed to the support frame of bars.

In yet another embodiment, mattress 20 is a spring mattress with pocket coils in a matrix on top of support member 21. Each pocket coil is a separate metal spring inside a fabric pocket. The fabric pockets are glued to the metal mesh panels, and then foam is molded between the fabric pockets and around the metal mesh panels. The foam encasement adds to the stability of the pocket coils and provides an amount of foam above the pockets coils.

Figure 6:
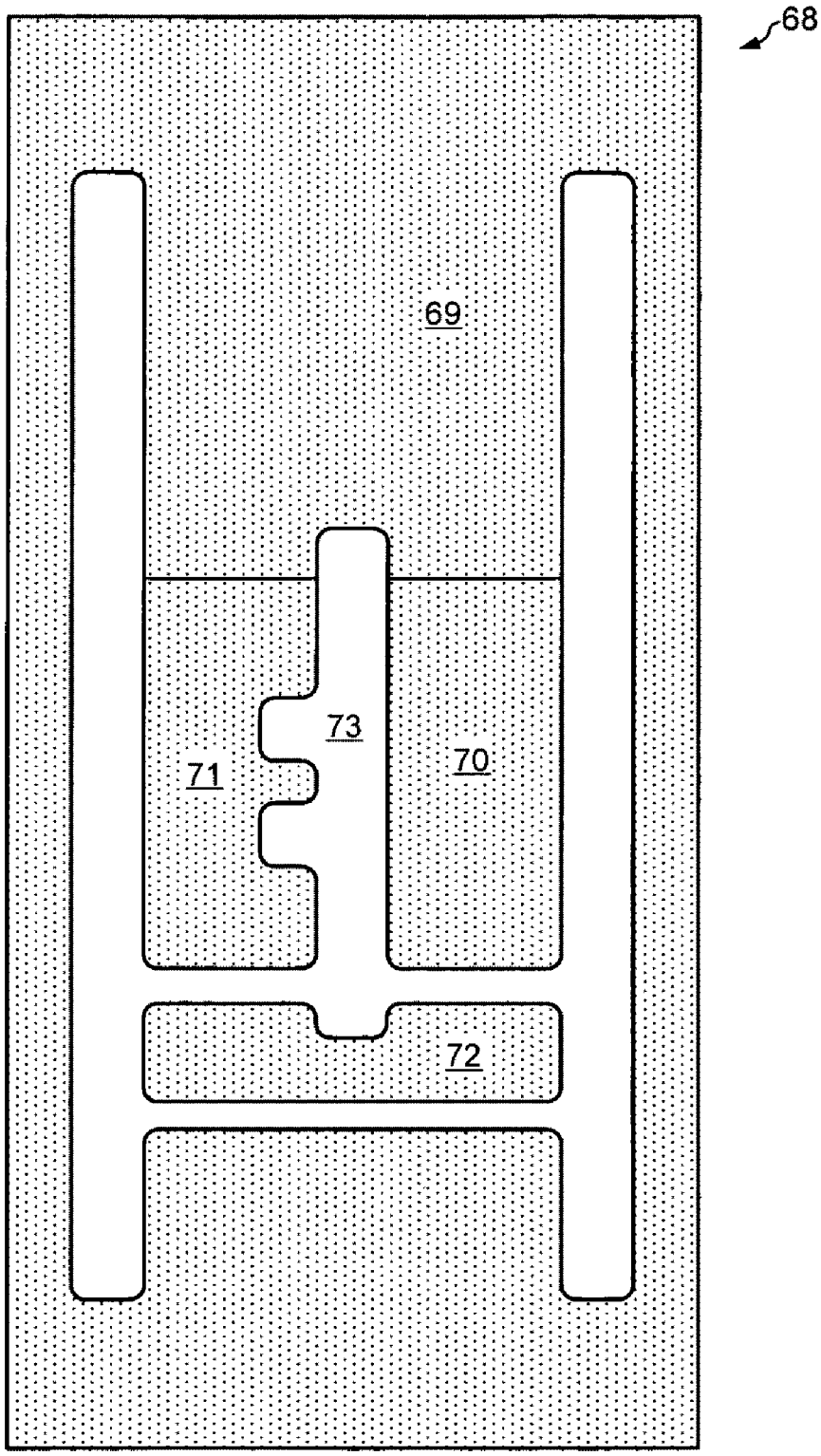
FIG. 6 is a top-down diagram of a template used to mold the foam of the bottom foam layer of the adjustable mattress of FIG. 2A.

FIG. 6 shows a template 68 by which the foam of bottom foam layer 37 is molded in four separate pieces 69-72. Template 68 prevents the liquid foam mixture from flowing into an open area 73 and covering the longitudinal bars, movement mechanism 33, second shaft 66 and cross bar 58. Top foam layer 36 does not have any open areas and has a solid rectangular shape. The bottom surface of top foam layer 36 is then glued to the top surface of bottom foam layer 37.

In another embodiment, a third layer of foam is attached to the bottom of bottom foam layer 37. The third foam layer is also molded and has the same open areas as bottom foam layer 37. The third foam layer is softer than bottom foam layer 37, which is made from harder, high-density foam that is more durable and less likely to tear and separate from the mesh panels as support member 21 changes configuration may times over the life of adjustable mattress 20.

In one embodiment, adjustable mattress 20 is eight inches thick. Bottom foam layer 37 is four inches thick and made of molded high density (HD) foam. Top foam layer 36 is four inches thick and is made of a first 2-inch sublayer of high density foam and a second 2-inch sublayer of visco-elastic (memory) foam. The top surface of the second sublayer of memory foam is top surface 40 of top foam layer 36. In another embodiment, the second sublayer is made of natural latex foam rubber. The dimensions of a Twin LX sized adjustable mattress 20 of this embodiment are thirty-eight inches by eighty inches by eight inches. Such an adjustable mattress fits in a cardboard box having the dimensions 39"×81"×9". Thus, adjustable mattress 20 is compact and can be delivered in a single box. Movement mechanism 12 and adjustable support member 11 of the prior art adjustable bed 10, on the other hand, are typically delivered is separate boxes which are each about as large of the box that contains adjustable mattress 20. And because the metal longitudinal and cross bars of support member 21 are encased in foam, less damage to hallways, elevators and walls is likely to occur when mattress 20 is being delivered to a customer. No tools or assembly is required because the movement mechanisms and support members inside mattress 20 are fully functional upon delivery.

Figure 7:
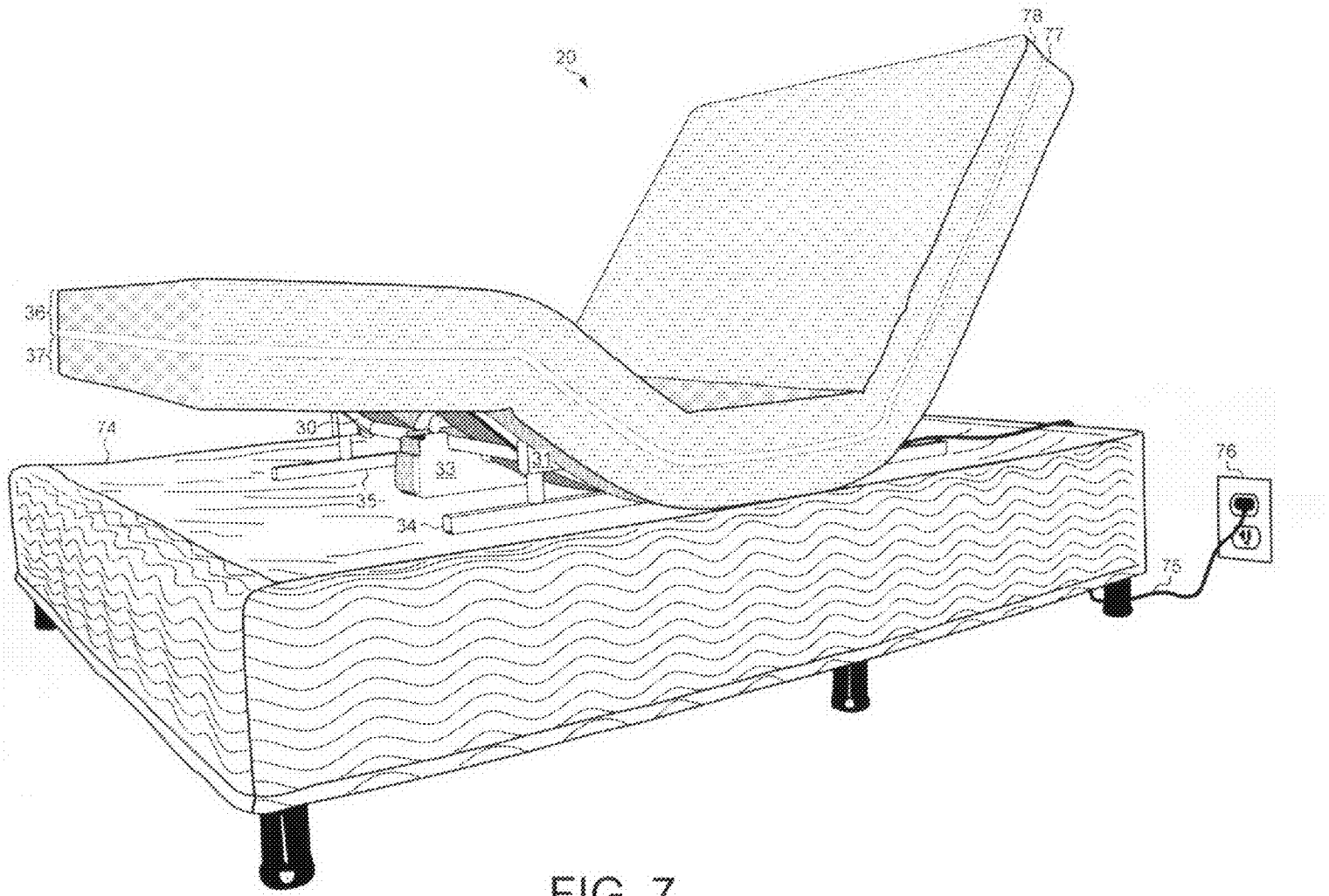
FIG. 7 is a perspective view of a self-adjusting mattress in an inclined configuration on top of a box spring base.

FIG. 7 is a perspective view of self-adjusting foam mattress 20 in an inclined configuration on top of a box spring base 74. Mattress cover 39 has been removed from mattress 20. Balancing bars 34-35 and movement mechanism 33 are visible beneath inclined lower section 24 and elevated foot section 25. In this embodiment, elevated foot section 25 is not entirely horizontal or parallel to middle section 23 but rather is slightly inclined. Balancing bars 34-35 do not extend out beneath foot section 25 and thereby imparts the appearance that self-adjusting foam mattress 20 is self-elevating. No separate adjustable support member as required by the prior art is used to incline and elevate the foam layers of adjustable mattress 20. Thus, adjustable mattress 20 can be placed directly on the top surface of box spring base 74 that would otherwise support a conventional mattress. When adjustable mattress 20 is in the flat configuration, mattress 20 looks like a conventional mattress resting on a box spring, with the exception of a power cord 75 that protrudes out from under the upper section of adjustable mattress 20. Power cord 75 is plugged into a standard wall socket 76 and provides electrical power to the electric motors 63 and 67 of the movement mechanism 33.

In the embodiment of FIG. 7, there is a thinner HD foam layer 77 that has been molded on top of lower foam layer 37. A thicker layer of memory foam 78 is then glued to the thin layer of HD foam. For example, a 1-inch layer of HD foam and a 3-inch layer of memory foam comprise upper foam layer 36 in the embodiment of FIG. 7.

In another embodiment, balancing bars 34-35 slide within tracks of longitudinal sliding bars (not shown) that rest on the top surface of box spring base 74. The sliding bars are used to provide "wall hugging" functionality. Movement mechanism 33 causes mattress 20 to move towards the head of the mattress as upper section 22 inclines such that the occupant's head remains adjacent to lights, books and remote controls sitting on a night stand.

Figure 8:
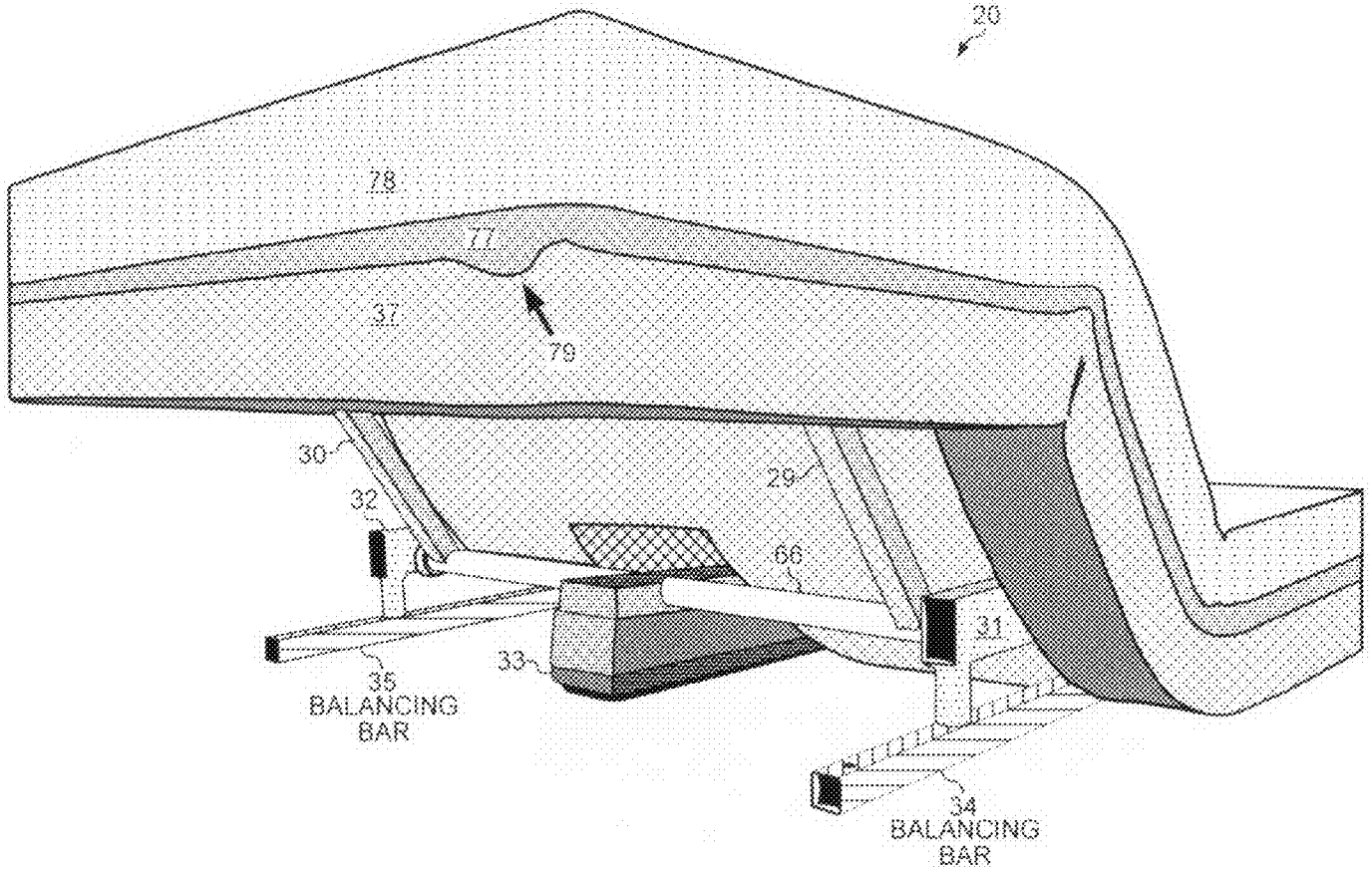
FIG. 8 shows the adjustable mattress of FIG. 7 from a different perspective.

FIG. 8 shows the embodiment of FIG. 7 from a different perspective. Upper section 22 is not shown in FIG. 8. The uneven boundary 79 between lower foam layer 37 and upper foam layer 36 shows that both lower foam layer 37 and the thin HD foam layer 77 of upper foam layer 36 are made in a molding process. A thicker memory foam layer 78 of upper foam layer 36 is then glued to thin HD foam layer 77. Part of one of the metal mesh panels that extends between the longitudinal bars of middle section 23 is apparent in FIG. 8 above movement mechanism 33. Template 68 prevented the molded foam from entering this open area 73 around movement mechanism 33. The metal mesh bends over and covers the top of movement mechanism 33 when adjustable mattress 20 is in the flat configuration. In the flat configuration, movement mechanism 33 is surrounded on four sides by the foam of lower foam layer 37 and on the top side by the foam of HD foam layer 77. Mattress cover 39 covers the bottom side of movement mechanism 33. By surrounding five of six sides of movement mechanism 33 with thick layers of foam, the sound of the moving motors 63 and 67 is dampened.

Figure 9:
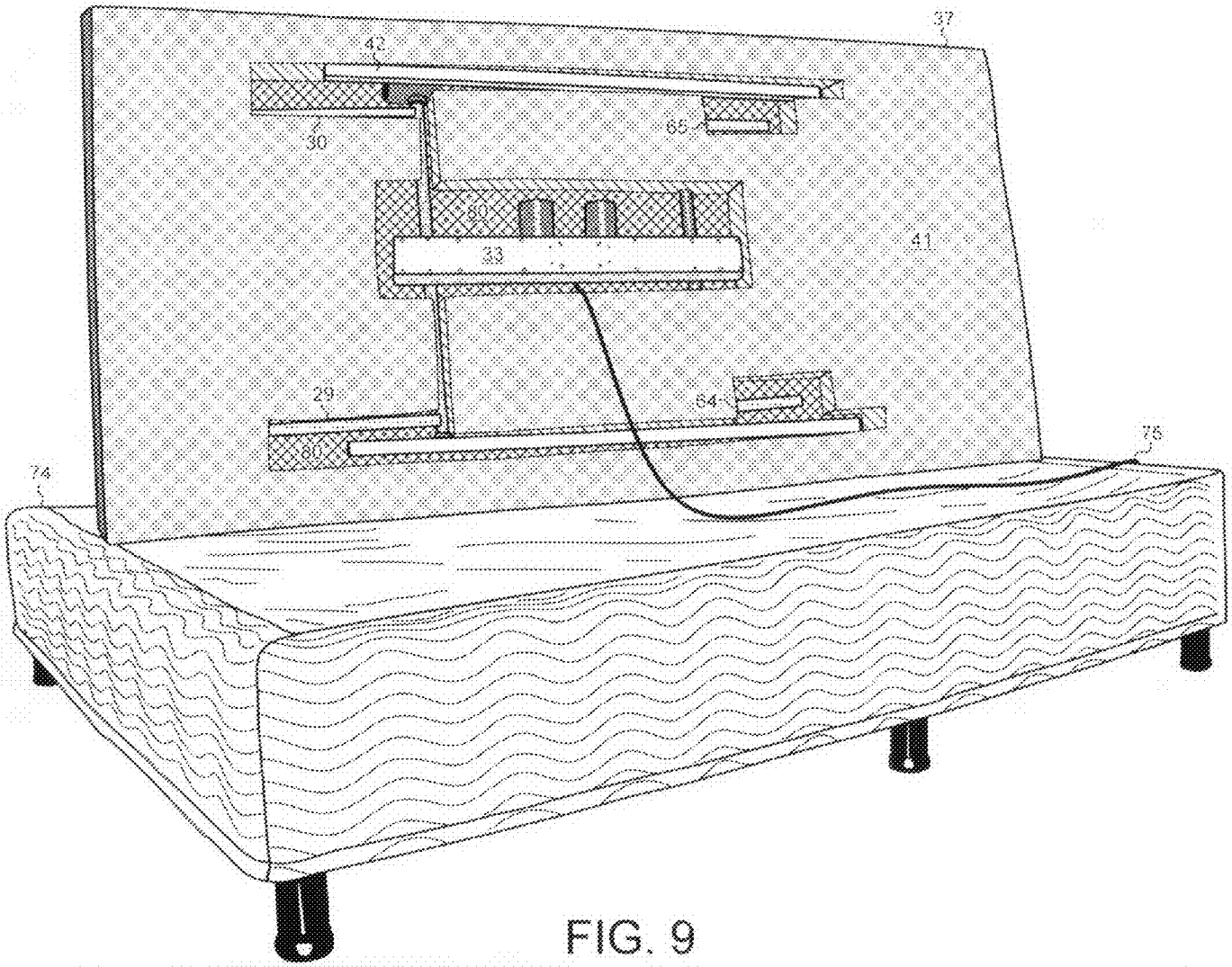
FIG. 9 is a perspective view of the bottom surface of the bottom foam layer of the adjustable mattress of FIG. 7.

FIG. 9 shows the embodiment of FIG. 7 with adjustable mattress 20 stood up on its side to reveal bottom surface 41 of bottom foam layer 37. In normal use, bottom surface 41 would rest on mattress cover 39 and on the supporting surface of box spring base 74. In this aspect, the template for molded foam is slightly different than template 68 of FIG. 6. For example, the template used to mold bottom foam layer 37 in FIG. 9 does not prevent cross bar 58 from being encased in foam. In this aspect, there is a single metal mesh 80 that covers the entire area between the longitudinal bars of support member 21. Thus, this aspect does not have multiple metal mesh panels.

Figure 10:
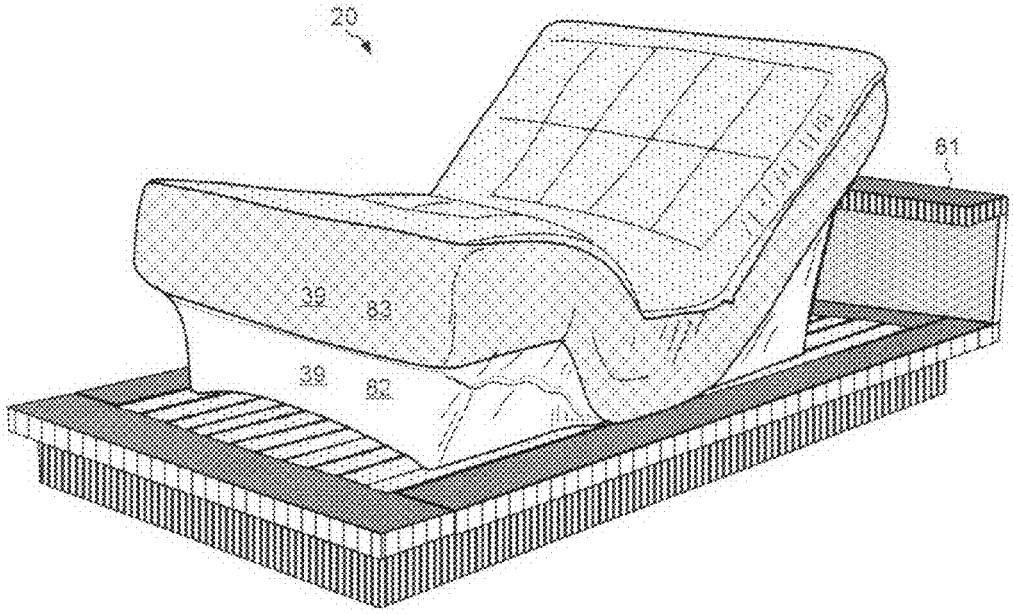
FIG. 10 is a perspective view of the adjustable mattress of FIG. 7 with a mattress cover in an inclined configuration on a platform bed.

FIG. 10 is a perspective view of self-adjusting foam mattress 20 with balancing bars 34-35 and integrated movement mechanism 33 covered by mattress cover 39. Mattress 20 is resting directly on the supporting surface of a platform bed 81 in an inclined configuration. The balancing bars of the embodiment of FIG. 10 extend farther out under foot section 25 than do the balancing bars of FIG. 8. Thus, when mattress cover 39 stretches between foot section 25 and balancing bars 34-35, there is less of an appearance that the mattress is self-levitating. Nevertheless, by making mattress cover 39 with patterned fabric, mattress 20 can be given a stylish appearance on a platform bed that does not resemble conventional adjustable beds found in hospitals and convalescent centers. In addition, no retention brackets or foot rails are required to prevent mattress 20 from shifting and sliding over an underlying support member.

Although the balancing bars of the embodiment of FIG. 10 extend farther out than do the balancing bars of FIG. 8, mattress cover 39 still forms an angle between the bottom of bottom foam layer 37 and the ends of the balancing bars, even when mattress 20 is nearly in a flat configuration. The angle of the mattress cover 39 under the bottom of the foam layers, however, is even more pronounced in the embodiments of FIGS. 2A and 3. Besides providing more of an appearance that the mattress is self-levitating, the sharper angle of mattress cover 39 under the foam layers created by shorter balancing bars also enables fitted sheets better to remain in place over the foam layers of mattress 20. A fitted sheet, also called a bottom sheet, is a sheet that covers a mattress and has an elastic seam that pulls the sheet together around the bottom of the mattress and helps the sheet to stay in place over the mattress. Alternatively, the fitted sheet has elastic sewn into each of the four corners instead of an entire seam. If the balancing bars approach the length of the foam layers, then there is little narrowing in mattress cover 39 from the foam layers to the balancing bars that provides a lip for a fitted sheet to tighten around the bottom of the foam layers. FIG. 10 shows the lip around the bottom of bottom foam layer 37 where mattress cover 39 stretches to the balancing bars. A fitted sheet would fit around this lip.

In the embodiment of FIG. 10, mattress cover 39 is made from two types of fabric. Only a bottom portion 82 that stretches from bottom foam layer 37 to balancing bars 34-35 is made of Spandex° or Lycra®. The top portion 83 of mattress cover 39 is made of a softer and thicker fabric that is more easily patterned. Bottom portion 82 of mattress cover 39 that stretched between the balancing bars and bottom foam layer 37 prevents pets and small children from being under self-adjusting mattress 20 when the mattress is returned to the flat configuration after being in an included configuration. Thus, in addition to keeping dust away from movement mechanism 33 and any exposed shafts and bars, mattress cover 39 also has a safety function. Bottom portion 82 also helps to dampen the sound of electric motors 63 and 67.

Figure 11:
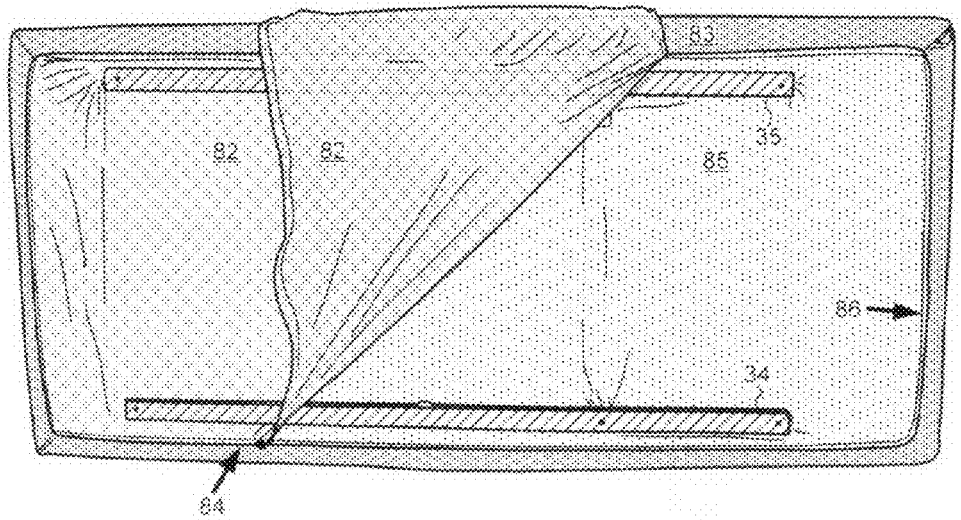
FIG. 11 shows the bottom of the adjustable mattress of FIG. 10 in a flat configuration.

FIG. 11 shows the bottom of the foam mattress 20 of FIG. 10 in a flat configuration. Mattress cover 39 actually has two bottom portions. Bottom portion 82 that is apparent in FIG. 10 is attached to the perimeter of top portion 83 with a zipper 84. Bottom portion 82 is made of a very stretchable fabric and covers the bottom surfaces of balancing bars 34-35. The boundary of top portion 83 and bottom portion 82 along zipper 84 is the extent of the lip around the bottom of the foam layers where the elastic band of a fitted sheet pulls the sheet tight around the bottom of the foam layers. A second bottom portion 85 is attached to the perimeter of top portion 83 at a second zipper 86 just inside of zipper 84. Second bottom portion 85 covers bottom surface 41 of bottom foam layer 37 but is situated between bottom foam layer 37 and balancing bars 34-35. When mattress 20 is positioned from the flat configuration to an inclined position, second bottom portion 85 remains adjacent to bottom surface 41 of bottom foam layer 37, while bottom portion 82 stretches between balancing bars 34-35 and bottom foam layer 37.

Figure 12A:
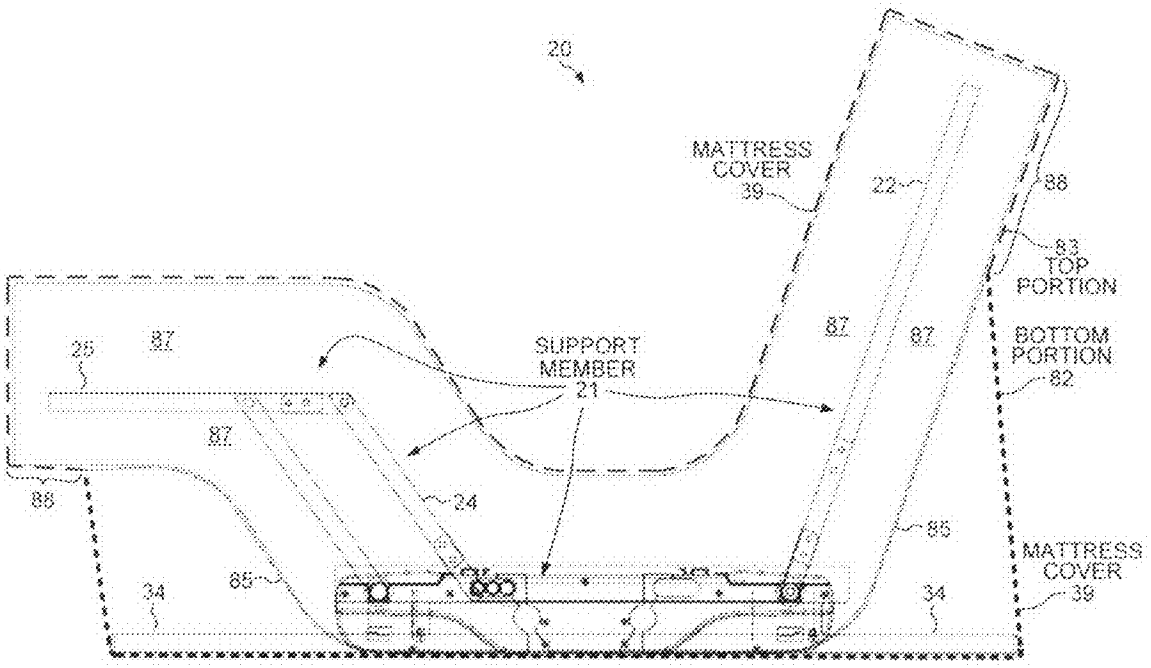
FIG. 12A is a schematic diagram of the adjustable mattress of FIG. 10 in an inclined configuration.
Figure 12B:
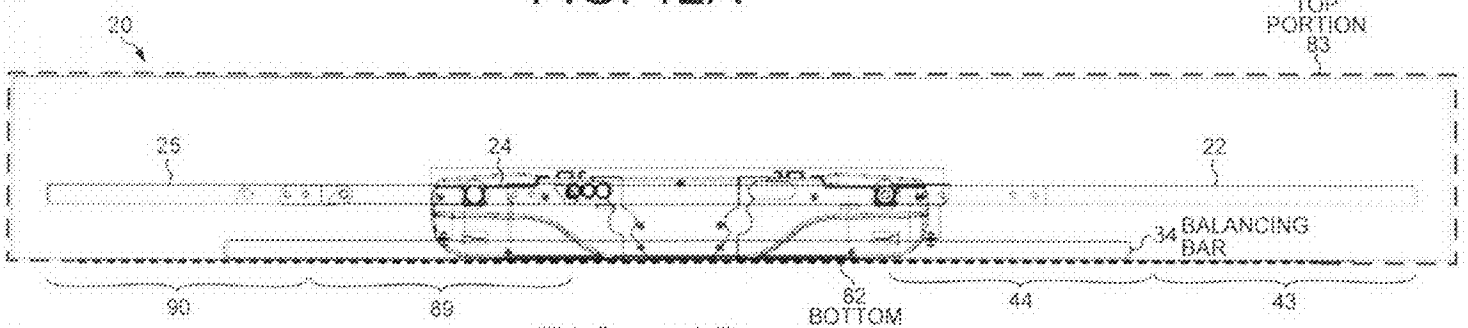
FIG. 12B is a schematic diagram of the adjustable mattress of FIG. 12A in a flat configuration.

FIGS. 12A and 12B are schematic diagrams of the embodiment of self-adjusting mattress 20 of FIG. 10. FIG. 12A shows that the embodiment of FIG. 12 has somewhat longer balancing bars than does the embodiment of FIG. 2. Balancing bar 34 extends farther out under lower section 24 and foot section 25 in the embodiment of FIG. 12 than in the embodiment of FIG. 2. The longer balancing bar prevents mattress 20 from tipping even if a person were to sit on foot section 25 when mattress 20 is in an inclined configuration.

In the embodiment of FIG. 12, a single foam layer 87 is molded around support member 21. Bottom portion 82 of mattress cover 39 is attached to top portion 83 of mattress cover farther away from the edge of the bottom foam layer than in the embodiment of FIG. 2. A lip 88 around the bottom of foam layer 87 extending to where bottom portion 82 of mattress cover 39 starts to stretch to the balancing bars is somewhat wider than the lip shown in FIG. 11. Lip 88 provides an area for the elastic band of a fitted sheet to fit around foam layer 87 and to remain in place over mattress 20. Top portion 83 of mattress cover 39 is made fabric that is less stretchable. Bottom portion 82 stretched between the balancing bars and zipper 84 that attaches bottom portion 82 to top portion 83. FIG. 12A also shows second bottom portion 85 that covers bottom surface 41 of foam layer 87 and is situated between foam layer 87 and balancing bars 34-35. Second bottom portion 85 remains adjacent to bottom surface 41 of foam layer 87, even when mattress 20 is in an inclined configuration.

FIG. 12B illustrates how far the balancing bars of the embodiment of FIG. 12 extend out under foot section 25 and upper section 22. Balancing bar 34 still extends less than half way under upper section 22 when adjustable mattress 20 is in the flat configuration. However, balancing bar 34 extends more than half way under the combined lower section 24 and foot section 25 when adjustable mattress 20 is in the flat configuration.

FIG. 12B shows an upper half 89 and a lower half 90 of the combined lower section 24 and foot section 25. Balancing bar 34 extends out past upper half 89 of the combined lower section 24 and foot section 25 when adjustable mattress 20 is in the flat configuration.

Figure 13:
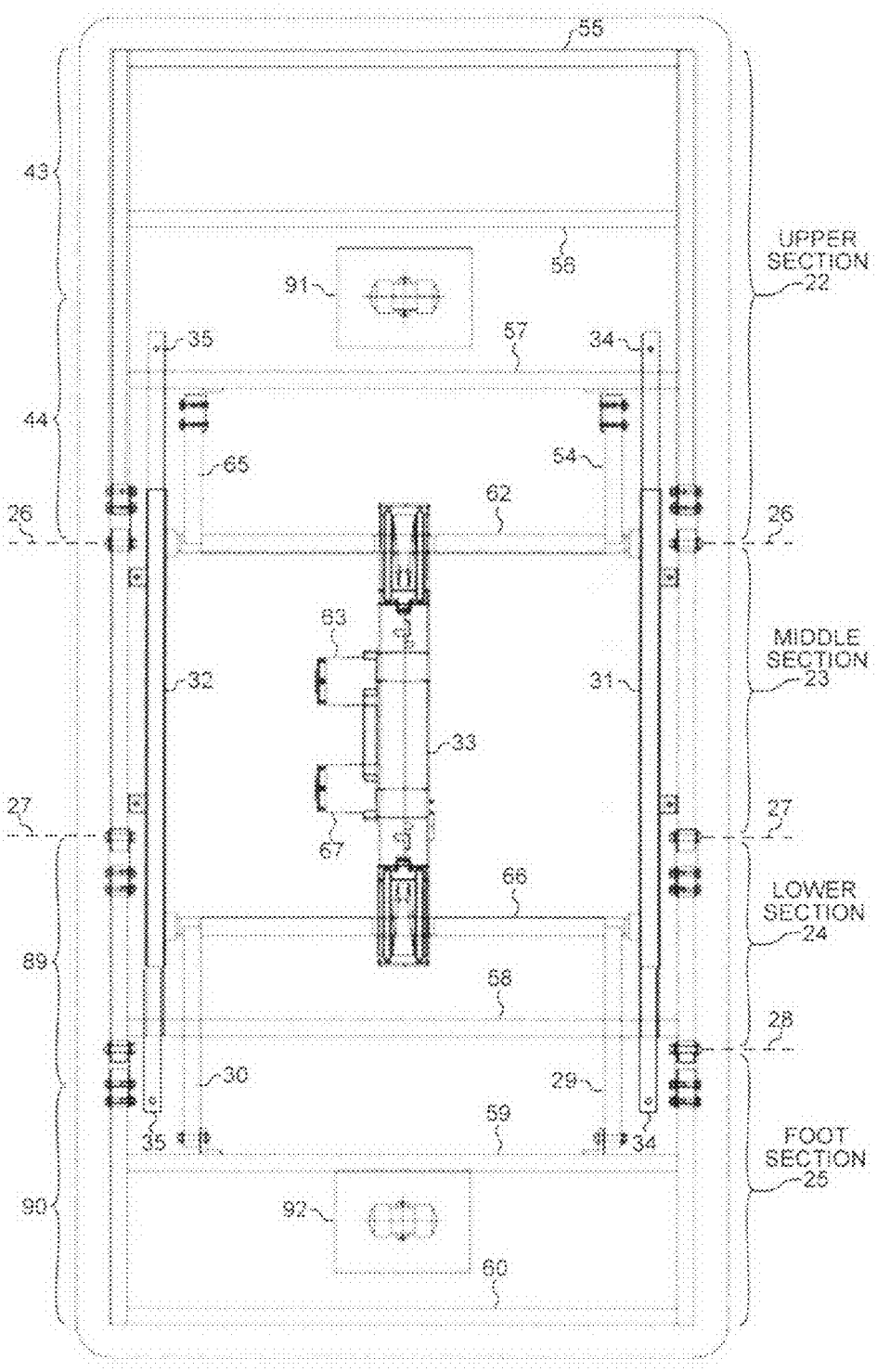
FIG. 13 is a top-down schematic diagram of the support member of the adjustable mattress of FIG. 12A in the flat configuration.

FIG. 13 is a top-down schematic diagram of the embodiment of the self-adjusting mattress 20 of FIG. 12 in a flat configuration. The two balancing bars 34-35 extend out past upper half 89 of the combined lower section 24 and foot section 25. FIG. 13 shows that the embodiment of FIG. 12 includes two additional electric motors 91-92 used to provide a massage to the occupant of mattress 20. Upper motor 91 generates the movement that provides a massage to the neck and upper back of the user of mattress 20, while lower motor 92 generates the movement that provides a massage to the user's feet.

Figure 14:
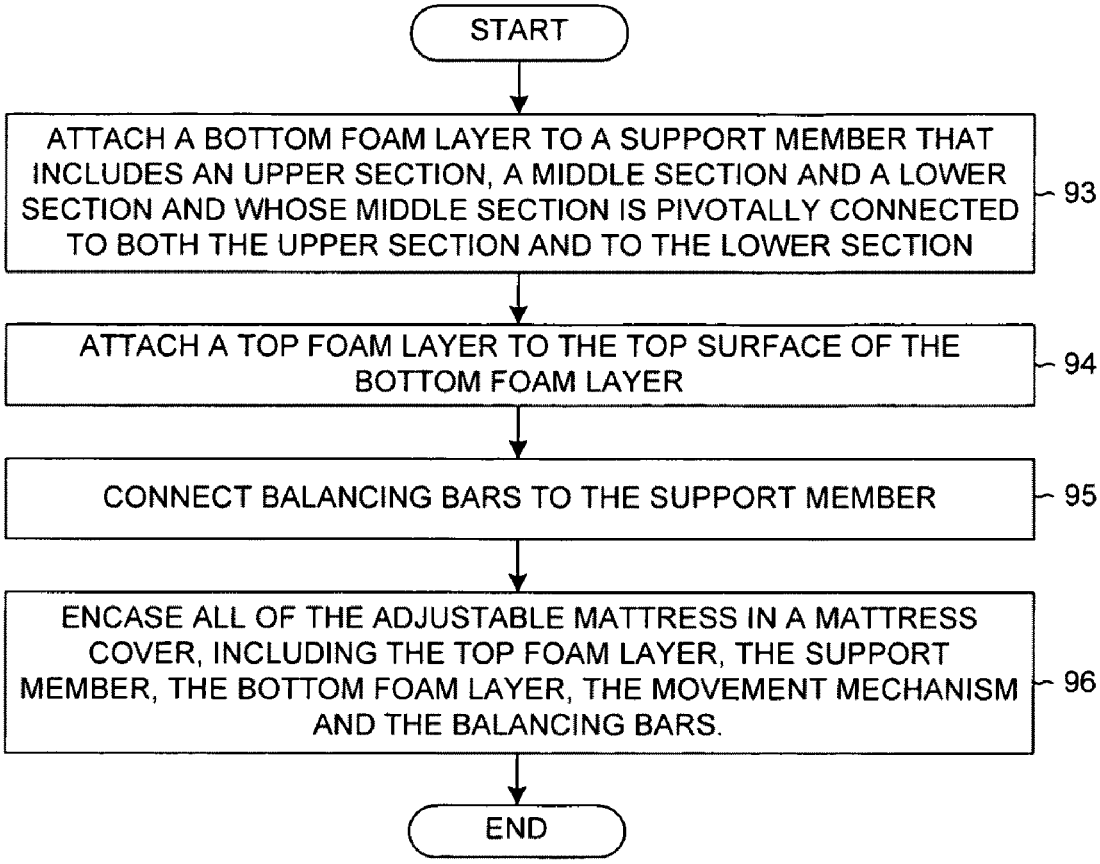
FIG. 14 is a flowchart of steps of a method of making the novel self-adjusting mattress of FIG. 2.

FIG. 14 is a flowchart illustrating steps 93-96 of a method making self-adjusting foam mattress 20. In a first step 93, bottom foam layer 37 is attached to support member 21 by molding foam around the bars and mesh. Template 68 is used to mold HD foam above and below the metal mesh panels as well as through the holes of the metal mesh panels. Template 68 prevents the molded foam from setting up in open area 73 and from covering the longitudinal bars and movement mechanism 33.

In step 94, top foam layer 36 is attached on top of bottom foam layer 37. In one embodiment, top foam layer 36 is a slab of cut memory foam that is glued to the top surface of bottom foam layer 37. In another embodiment, top foam layer 36 includes two sublayers. A first sublayer of high density foam is molded over and adheres to the top surface of bottom foam layer 37. Then a second sublayer of memory foam is glued to the top surface of the first sublayer. The top surface of the second sublayer of memory foam becomes top surface 40 of top foam layer 36. After steps 93-94, support member 21 is disposed entirely between top surface 40 of top foam layer 36 and bottom surface 41 of bottom foam layer 37.

In step 95, balancing bars 34-35 are connected to support member 21. Balancing bar 34 is situated below central support beam 31 and is attached to central support beam 31, which in turn is attached to the longitudinal bar of middle section 23. Similarly, balancing bar 35 is attached to central support beam 32, which is attached to the other longitudinal bar of middle section 23. Bottom surface 42 of balancing bar 34 is coplanar with bottom surface 41 of bottom foam layer 37 beneath middle section 23. Balancing bar 34 extends less than half way under upper section 22 when upper section 22 is parallel to bottom surface 42 of balancing bar 34.

In step 96, the entire adjustable mattress 20 is encased in mattress cover 39. Mattress cover 39 encloses top foam layer 36, support member 21, bottom foam layer 37, movement mechanism 33 and balancing bars 34-35. In one embodiment, top portion 83 of mattress cover 39 is fitted over the foam layers of mattress 20 before step 95. Then after balancing bars 34-35 are connected to support member 21, the entire adjustable mattress 20 is encased in mattress cover 39 by using zipper 84 to attach bottom portion 82 to top portion 83 of mattress cover 39 and thereby cover the balancing bars.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An adjustable mattress, comprising:

a support member including an upper section, a middle section and a lower section, wherein the middle section is pivotally connected to both the upper section and to the lower section, wherein the upper section, the middle section and the lower section are coplanar when the adjustable mattress is in a flat configuration;

a top foam layer with a top surface;

a bottom foam layer with a bottom surface, wherein the support member is disposed between the top surface of the top foam layer and the bottom surface of the bottom foam layer;

a balancing bar with a bottom surface, wherein the bottom surface of the balancing bar is coplanar with the bottom surface of the bottom foam layer beneath the middle section, wherein the balancing bar extends at least one third of the way under the upper section when the adjustable mattress is in a flat configuration, and wherein the balancing bar extends less than half way under the upper section when the adjustable mattress is in the flat configuration; and a mattress cover that encases the top foam layer, the support member, the bottom foam layer and the balancing bar, wherein the mattress cover is stretchable, wherein the bottom surface of the balancing bar lies in a plane, and wherein the mattress cover stretches between the balancing bar and the bottom foam layer beneath the upper section of the support member when the upper section is inclined from the plane of the bottom surface of the balancing bar.

2. The adjustable mattress of claim 1, wherein the upper section has an upper half and a lower half, wherein the bottom surface of the balancing bar lies in a plane, and wherein no part of the adjustable mattress is disposed in the plane of the bottom surface of the balancing bar directly below the upper half of the upper section when the upper section is inclined five degrees from the plane of the bottom surface of the balancing bar.

3. The adjustable mattress of claim 1, wherein the mattress cover has a top portion and a bottom portion, wherein the bottom portion is made of a stretchable first material, wherein the top portion is made of a second material that is less stretchable than the first material, and wherein the bottom portion stretches between the balancing bar and the bottom foam layer beneath the upper section of the support member when the upper section is inclined from the plane of the bottom surface of the balancing bar.

4. The adjustable mattress of claim 1, wherein the support member includes a foot section that is pivotally connected to the lower section, wherein the bottom surface of the balancing bar lies in a plane, and wherein the foot section remains parallel to the middle section as the lower section is inclined from the plane of the bottom surface of the balancing bar.

5. The adjustable mattress of claim 1, further comprising:

an electric motor disposed between the top surface of the top foam layer and the bottom surface of the bottom foam layer, wherein the electric motor is adapted to incline the upper section in relation to the middle section.

6. The adjustable mattress of claim 1, wherein the upper section of the support member includes a mesh panel, and wherein the bottom foam layer is molded above, below and through the mesh panel.

7. An adjustable mattress, comprising:

an upper section with an upper support member, wherein the upper support member is disposed between a top foam layer and a bottom foam layer;

an middle section with a middle support member, wherein the middle support member is disposed between the top foam layer and the bottom foam layer;

a lower section with a lower support member, wherein the lower support member is disposed between the top foam layer and the bottom foam layer;

a balancing bar with a bottom surface, wherein the bottom foam layer has a bottom surface, and wherein the bottom surface of the balancing bar is coplanar with the bottom surface of the bottom foam layer at the middle section, wherein the middle support member is pivotally connected to both the upper support member and to the lower support member, wherein the balancing bar is parallel to the upper support member when the upper section is in a flat configuration, wherein the balancing bar extends at least one third of the way under the upper section when the upper section is in the flat configuration, and wherein the balancing bar extends from under the middle section less than half way under the upper section when the upper section is in the flat configuration; and a mattress cover that encases the upper section, the middle section, the lower section and the balancing bar, wherein the mattress cover is stretchable, wherein the bottom surface of the balancing bar lies in a plane, and wherein the mattress cover stretches between the balancing bar and the bottom foam layer beneath the upper section when the upper section is inclined from the plane of the bottom surface of the balancing bar.

8. The adjustable mattress of claim 7, wherein the upper section has an upper half and a lower half, and wherein no part of the adjustable mattress is disposed directly below the upper half of the upper section when the upper section is inclined five degrees from the plane of the bottom surface of the balancing bar.

9. The adjustable mattress of claim 7, further comprising:

a foot section with a foot support member, wherein the foot support member is pivotally connected to the lower support member, wherein the bottom surface of the balancing bar lies in a plane, and wherein the foot support member remains parallel to the middle support member as the lower section is inclined from the plane of the bottom surface of the balancing bar.

10. A method comprising:

attaching a bottom foam layer to a support member, wherein the support member includes an upper section, a middle section and a lower section, wherein the middle section is pivotally connected to both the upper section and to the lower section;

attaching a top foam layer to the bottom foam layer, wherein the support member is disposed between a top surface of the top foam layer and a bottom surface of the bottom foam layer;

connecting a balancing bar to the support member, wherein the balancing bar has a bottom surface that is coplanar with the bottom surface of the bottom foam layer beneath the middle section, wherein the balancing bar extends at least one third of the way under the upper section when the upper section is parallel to the bottom surface of the balancing bar, and wherein the balancing bar extends less than half way under the upper section when the upper section is parallel to the bottom surface of the balancing bar; and encasing the top foam layer, the support member, the bottom foam layer and the balancing bar in a mattress cover, wherein the mattress cover is stretchable, and wherein the mattress cover stretches between the balancing bar and the bottom foam layer beneath the upper section when the upper section is inclined from the bottom surface of the balancing bar.

11. The method of claim 10, wherein the support member includes a foot section that is pivotally connected to the lower section, wherein the bottom surface of the balancing bar lies in a plane, and wherein the foot section remains parallel to the middle section as the lower section is inclined from the plane of the bottom surface of the balancing bar.

12. The method of claim 10, wherein the upper section of the support member includes a mesh panel, and wherein the bottom foam layer is attached to the support member by molding the bottom foam layer above, below and through the mesh panel.

13. An adjustable mattress, comprising:

a support frame of bars including an upper section, a middle section, a lower section and a foot section, wherein the middle section is pivotally connected to both the upper section and to the lower section, wherein the upper section, the middle section, the lower section and the foot section are coplanar when the adjustable mattress is in a flat configuration;

a top foam layer with a top surface;

a bottom foam layer with a bottom surface, wherein the support frame of bars is disposed between the top surface of the top foam layer and the bottom surface of the bottom foam layer;

an electric motor disposed between the top surface of the top foam layer and the bottom surface of the bottom foam layer, wherein the electric motor is adapted to incline the lower section in relation to the middle section, and wherein the foot section remains parallel to the middle section as the lower section is inclined; and means for attaching the bottom foam layer to the support frame of bars without using glue, wherein the bottom foam layer is molded above, below and through the means.

14. The adjustable mattress of claim 13, wherein the means is a sheet with holes and is attached to the support frame of bars, and wherein foam of the bottom foam layer is disposed in the holes.

15. The adjustable mattress of claim 13, further comprising:

a balancing bar with a bottom surface, wherein the bottom surface of the balancing bar is coplanar with the bottom surface of the bottom foam layer beneath the middle section, wherein the balancing bar extends at least one third of the way under the upper section when the upper section is in the flat configuration, and wherein the balancing bar extends less than half way under the upper section when the adjustable mattress is in the flat configuration.

16. The adjustable mattress of claim 15, further comprising:

a mattress cover that encases the upper section, the middle section, the lower section, the foot section and the balancing bar, wherein the mattress cover is stretchable, and wherein the mattress cover stretches between the balancing bar and the bottom foam layer beneath the upper section when the upper section is inclined.

17. The adjustable mattress of claim 13, wherein the means is a metal mesh panel that is welded to the support frame of bars.

18. The adjustable mattress of claim 13, wherein the means is a stiff plastic sheet with holes.

* * * * *